US007094509B2

(12) United States Patent
Tong et al.

(10) Patent No.: US 7,094,509 B2
(45) Date of Patent: Aug. 22, 2006

(54) FLUOROPOLYMER CONTAINING PHOTOCONDUCTIVE MEMBER

(75) Inventors: Yuhua Tong, Webster, NY (US); Timothy J. Fuller, Pittsford, NY (US); Cindy C. Chen, Rochester, NY (US); John F. Yanus, Webster, NY (US); Robert C. U. Yu, Webster, NY (US); Min-Hong Fu, Webster, NY (US); Lanhui Zhang, Penfield, NY (US); Dennis J. Prosser, Walworth, NY (US); Susan M. VanDusen, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 58 days.

(21) Appl. No.: 10/622,341

(22) Filed: Jul. 18, 2003

(65) Prior Publication Data

US 2005/0014080 A1 Jan. 20, 2005

(51) Int. Cl.
*G03G 5/047* (2006.01)

(52) U.S. Cl. ..... 430/58.8; 430/59.6; 430/58.75; 430/58.05

(58) Field of Classification Search ..... 430/59.6, 430/66, 67, 58.8, 59.4, 59.5, 58.05
See application file for complete search history.

(56) References Cited

U.S. PATENT DOCUMENTS

| | | | | |
|---|---|---|---|---|
| 4,265,990 | A | 5/1981 | Stolka et al. | 430/59 |
| 5,357,320 | A * | 10/1994 | Kashimura et al. | 430/66 |
| 5,473,064 | A | 12/1995 | Mayo et al. | 540/141 |
| 5,480,759 | A * | 1/1996 | Kasuya et al. | 430/66 |
| 5,482,811 | A | 1/1996 | Keoshkerian et al. | 430/135 |
| 6,015,645 | A | 1/2000 | Murti et al. | 430/59 |
| 6,156,468 | A | 12/2000 | Wehelie et al. | 430/65 |
| 6,287,737 | B1 | 9/2001 | Ong et al. | 430/58.8 |

OTHER PUBLICATIONS

Diamond, Arthur S. & David Weiss (eds.) Handbook of Imaging Materials, 2nd edition. New York: Marcel-Dekker, Inc. (Nov. 2001) pp. 370-395.*

Diamond, Arthur S & David Weiss (eds.) Handbook of Imaging Materials. New York: Marcel-Dekker, Inc. (Nov. 2001) pp. 401-403.*

Copending U.S. Appl. No. 10/369,797, filed Feb. 19, 2003, on "Photoconductive Imaging Members" by Yuhua Tong et al.

* cited by examiner

*Primary Examiner*—Christopher Rodee
(74) *Attorney, Agent, or Firm*—Eugene O. Palazzo; Fay, Sharpe, Fagan, Minnich & McKee, LLP

(57) ABSTRACT

A photoconductive imaging member comprised of a photogenerating layer, and a charge transport layer containing a binder and a fluoropolymer generated by the free radical polymerization of a fluoroalkyl(methyl)acrylate and an alkyl (methyl)acrylate.

22 Claims, No Drawings

FLUOROPOLYMER CONTAINING PHOTOCONDUCTIVE MEMBER

CROSS REFERENCES

Illustrated in U.S. Pat. No. 6,800,411, filed Feb. 19, 2003 on Photoconductive Imaging Members, the disclosure of which is totally incorporated herein by reference, is, for example, a photoconductive imaging member comprised of a substrate, a photogenerating layer, and a charge transport layer containing a binder and a multi-(methyl)acrylate.

There is illustrated in copending U.S. Ser. No. 10/370,186, filed Feb. 19, 2003 on Photoconductive Imaging Members, Publication No. 20040161683, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether and hydroxy group containing polymer.

There is illustrated in U.S. Pat. No. 6,913,863, filed Feb. 19, 2003 on Photoconductive Imaging Members, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of phenolic compounds and a phenolic resin wherein the phenolic compound contains at least two phenol groups.

There is illustrated in U.S. Pat. No. 6,824.940, filed Feb. 19, 2003 on Photoconductive Imaging Members, the disclosure of which is totally incorporated herein by reference, is a photoconductive imaging member comprised of a hole blocking layer, a photogenerating layer, a charge transport layer, and thereover an overcoat layer comprised of a polymer with a low dielectric constant and charge transport molecules.

The components, such as photogenerating pigments, charge transport compounds, supporting substrates, hole blocking layers and binder polymers, and processes of the copending applications may be selected for the present invention in embodiments thereof.

RELATED PATENTS

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water

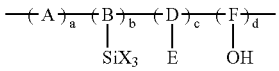

(I)

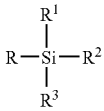

(II)

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components and processes of the above patents may be selected for the present invention in embodiments thereof.

BACKGROUND

This invention is generally directed to imaging members, and more specifically, the present invention is directed to multi-layered photoconductive imaging members with a photogenerating layer, a charge transport layer, an optional hole blocking, or undercoat layer (UCL), and wherein the charge transport layer can be comprised of the polymer blend illustrated herein containing, for example, a binder and a soluble fluoropolymer or fluoro-containing polymer of, for example, a copolymer generated by the free radical polymerization of a fluoroalkyl(methyl)acrylate and an alkyl (methyl)acrylate.

In embodiments, the photogenerating layer can be situated between the charge transport layer and the supporting substrate, and the hole blocking layer in contact with the supporting substrate can be situated between the supporting substrate and the photogenerating layer, which is comprised, for example, of the photogenerating pigments of U.S. Pat. No. 5,482,811, the disclosure of which is totally incorporated herein by reference, especially Type V hydroxygallium phthalocyanine, and generally metal free phthalocyanines, metal phthalocyanines, hydroxy gallium phthalocyanines, perylenes, titanyl phthalocyanines, selenium, selenium alloys, azo pigments, squaraines, and the like.

The imaging members of the present invention in embodiments possess a charge transport layer with a low surface energy, and excellent resistance to cracking against exposure to chemical vapors emitted from solvents. The charge transport layer's solvent vapor resistance and/or its antiorganic solvent characteristics can be determined by the known solvent vapor induced crystallization test, wherein the imaging member is subjected to exposure by the vapor of common organic solvents, such as for example, methylene chloride, isopropyl alcohol, propylene glycol, a cyclic siloxane of an eight member ring polydimethylsiloxane, tetrahydrofuran, toluene, and the like. Furthermore, the charge transport layer's excellent surface properties, such as for example a low surface energy, can be measured and determined by the water contact angle, and which angle is, for example, from about 100 to about 115, and more specifically, about 109.6+−0.8 degrees. Also, in embodiments the imaging members of the present invention exhibit excellent cyclic/environmental stability; excellent wear characteristics; enhanced toner image transfer efficiency to the image receiving member; extended lifetimes of, for example, up to 2,500,000 imaging cycles; acceptable and in some instances improved electrical characteristics; compatibility of the charge transport components with the soluble fluoropolymer of, for example, a polymer generated by the free radical polymerization of a fluoro(methyl)acrylate; members which can be economically prepared with tunable or preselected properties depending, for example, on the amount of fluoropolymer contained in the charge transport layer, and which amount can be controlled by adjusting the feed ratios of the initial monomers; for example, in the copolymerization of trifluoroethyl methacrylate (TFE-MA) and methyl methacrylate (MMA), the higher concentration of TFE-MA in the feeding materials will usually result in fluoropolymer with a lower surface energy.

Processes of imaging, especially xerographic imaging and printing, including digital, are also encompassed by the present invention. More specifically, the photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 475 to about 950 nanometers, and in particular from about 650 to about 850 nanometers, thus diode lasers can be selected as the light source. Moreover, the imaging members of this invention are useful in color xerographic applications, particularly high-speed color copying and printing processes.

REFERENCES

Layered photoresponsive imaging members have been illustrated in numerous U.S. patents, such as U.S. Pat. No. 4,265,990, the disclosure of which is totally incorporated herein by reference, wherein there is illustrated an imaging member comprised of a photogenerating layer, and an arylamine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

The use of perylene pigments as photoconductive substances are also known. There is thus described in Hoechst European Patent Publication 0040402, DE3019326, filed May 21, 1980, the use of NAN-disubstituted perylene-3,4,9,10-tetracarboxyldiimide pigments as photoconductive substances. Specifically, there is, for example, disclosed in this publication NAN-bis(3-methoxypropyl)perylene-3,4,9,10-tetracarboxyldiimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882, the disclosure of which is totally incorporated herein by reference, photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are disclosed in this patent dual layer photoreceptors with perylene-3,4,9,10-tetracarboxylic acid diimide derivatives, which have spectral response in the wavelength region of from about 400 to about 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Also known are charge transport aryl amine components, such as N,N'-diphenyl-N,N'-bis(3-methylhenyl)-1,1'-biphenyl-4,4'-diamine dispersed in a polycarbonate binder as a hole transport layer. The above components, such as the photogenerating compounds and the aryl amine charge transport molecule, can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors, and specifically, for example, imaging members containing a hole blocking layer of a plurality of light scattering particles dispersed in a binder, reference for example Example I of U.S. Pat. No. 6,156,468, the disclosure of which is totally incorporated herein by reference, wherein there is illustrated a hole blocking layer of titanium dioxide dispersed in a specific linear phenolic binder of VARCUM, available from OxyChem Company.

SUMMARY

It is a feature of the present invention to provide imaging members with many of the advantages illustrated herein, such as extended lifetimes of service of, for example, in excess of about 3,000,000 imaging cycles; excellent electronic characteristics; stable electrical properties; resistance to charge transport layer cracking upon exposure to the vapor of certain solvents; superior surface characteristics; improved wear resistance; and the like.

Another feature of the present invention relates to the provision of layered photoresponsive imaging members, which are responsive to near infrared radiation of from about 700 to about 900 nanometers.

It is yet another feature of the present invention to provide layered photoresponsive imaging members with sensitivity to visible light.

Moreover, another feature of the present invention relates to the provision of layered photoresponsive imaging members with mechanically robust and solvent resistant charge transport layers.

In a further feature of the present invention there are provided imaging members containing compatible soluble fluoropolymers wherein soluble refers, for example, to about 1.2 grams of the fluoropolymer dissolved in 10 milliliters of a solvent like tetrahydrofuran.

Moreover, in yet another feature of the present invention there are provided imaging members with optional hole blocking layers comprised of metal oxides, phenolic resins, and optional phenolic compounds, and which phenolic compounds containing at least two, and more specifically two to ten phenol groups or phenolic resins with a weight average molecular weight ranging from about 500 to about 2,000, can interact with and consume aldehyde compounds, such as formaldehyde and other phenolic precursors, thereby chemically modifying the properties for such resins and permitting, for example, a hole blocking layer with excellent efficient electron transport, and which usually results in a desirable lower residual potential $V_{low}$.

Aspects of the present invention relate to a member comprised of a photogenerating layer, and a charge transport layer containing a binder and a fluoropolymer generated by the free radical polymerization of a fluoroalkyl(methyl) acrylate and an alkyl(methyl)acrylate; a photoconductive imaging member comprised in sequence of a substrate, a photogenerating layer, and a charge transport layer comprised of charge transport molecules, a polymer and a fluoropolymer generated from the polymerization of a fluoroalkyl(methyl)acrylate and an alkyl(methyl)acrylate, and optionally which fluoropolymer possesses a solubility of from about 0.1 gram/milliliter to about 50 grams/milliliter in organic solvents of, for example, acetone, methylene chloride, toluene and tetrahydrofuran; a member comprised of a substrate, a photogenerating layer, and a charge transport layer comprised of a charge transport component, a polymer binder, and a fluoropolymer of a fluoroalkyl(methyl)acrylate, and an alkyl(methyl)acrylate; a photoconductive imaging member comprised of a supporting substrate, a hole blocking layer thereover, a photogenerating layer and a charge transport layer comprised of hole transport molecules, binder, and the fluoropolymer illustrated herein; and optionally a top layer comprised, for example, of known low dielectric components; a photoconductive imaging member wherein the supporting substrate is comprised of a known component, such as a conductive metal substrate; a photoconductive imaging member wherein the conductive substrate is aluminum, aluminized polyethylene terephthalate or a titanized polyethylene naphthalate; a photoconductive imaging member wherein the photogenerating layer is of a thickness of from about 0.05 to about 10 microns; a photoconductive imaging member wherein the charge, such as hole transport layer, is of a thickness of from about 10 to about 50 microns; a photoconductive imaging member wherein the photogenerating layer is comprised of photogenerating pigments dispersed in an optional resinous binder in an amount of from about 5 percent by weight to about 95 percent by weight; a photoconductive imaging member wherein the photogenerating resinous binder is selected from the group consisting of copolymers of vinyl chloride, vinyl acetate and hydroxy and/or acid containing monomers, polyesters, polyvinyl butyrals, polycarbonates, polystyrene-b-polyvinyl pyridine, and polyvinyl formals; a photoconductive imaging member wherein the charge transport layer comprises a thermoplastic polymer binder and aryl amine molecules; a photoconductive imaging wherein the charge transport contains

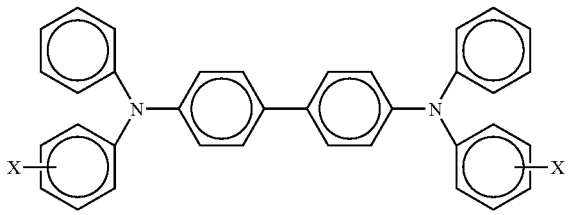

wherein X is selected from the group consisting of alkyl, alkoxy and halogen, and wherein the aryl amine is dispersed in a resinous binder; a photoconductive imaging member wherein the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, alkylhydroxygallium phthalocyanines, hydroxygallium phthalocyanines, or mixtures thereof; a photoconductive imaging member wherein the photogenerating layer is comprised of Type V hydroxygallium phthalocyanine; a method of imaging which comprises generating an electrostatic latent image on the imaging member illustrated herein, developing the latent image, and transferring the developed electrostatic image to a suitable substrate; an imaging member wherein the hole blocking layer phenolic compound is bisphenol S, 4,4'-sulfonyidiphenol; an imaging member wherein the phenolic compound is bisphenol A, 4,4'-isopropylidenediphenol; an imaging member wherein the phenolic compound is bisphenol E, 4,4'-ethylidenebisphenol; an imaging member wherein the phenolic compound is bisphenol F, bis(4-hydroxyphenyl)methane; an imaging member wherein the phenolic compound is bisphenol M, 4,4'-(1,3-phenylenediisopropylidene)bisphenol; an imaging member wherein the phenolic compound is bisphenol P, 4,4'-(1,4-phenylenediisopropylidene)bisphenol; an imaging member wherein the phenolic compound is bisphenol Z, 4,4'-cyclohexylidenebisphenol; an imaging member wherein the phenolic compound is hexafluorobisphenol A, 4,4'-(hexafluoroisopropylidene)diphenol; an imaging member wherein the phenolic compound is resorcinol, 1,3-benzenediol; an imaging member wherein the phenolic compound is hydroxyquinone, 1,4-benzenediol; an imaging member wherein the phenolic compound is of the formula Catechin

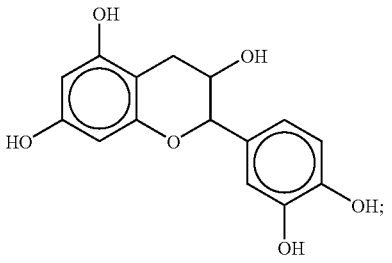

an imaging member wherein the phenolic resin is selected from the group consisting of a formaldehyde polymer generated with phenol, p-tert-butylphenol and cresol; a formaldehyde polymer generated with ammonia, cresol and phenol; a formaldehyde polymer generated with 4,4'-(1-methylethylidene)bisphenol; a formaldehyde polymer generated with cresol and phenol; and a formaldehyde polymer generated with phenol and p-tert-butylphenol; an imaging member comprised in the sequence of a supporting substrate, a hole blocking layer, an optional adhesive layer, a photogenerating layer, and a charge transport layer as illustrated herein and comprised of a charge transport compound, such as hole transport components and a polymer blend comprised of a resin binder and a soluble fluoropolymer of, for example, a copolymer generated by the free radical polymerization of a fluoroalkyl(methyl)acrylate and an alkyl(methyl)acrylate; an imaging member wherein the adhesive layer is comprised of a polyester with an $M_w$ of about 45,000 to about 75,000, and an $M_n$ of from about 30,000 about 40,000; an imaging member wherein the photogenerator layer is of a thickness of from about 1 to about 5 microns, and wherein the transport layer is of a thickness of from about 20 to about 75 microns; an imaging member wherein the photogenerating layer is comprised of photogenerating pigments dispersed in a resinous binder in an amount of from about 15 percent by weight to about 90 percent by weight, and optionally wherein the resinous binder is selected from the group comprised of vinyl chloride/vinyl acetate copolymers, polyesters, polyvinyl butyrals, polycarbonates, polystyrene-b-polyvinyl pyridine, and polyvinyl formals; and an imaging member wherein the charge transport layer comprises suitable known or future developed components, and more specifically, aryl amines, and which aryl amines are molecules of the formula

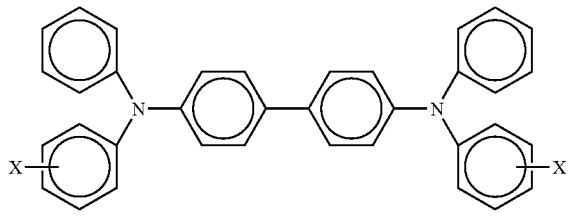

wherein X is alkyl and the like; and which amines are dispersed in a binder polymer and the fluoropolymers illustrated herein.

Fluoropolymers, which are soluble in, for example, a number of solvents selected for the coating of the charge transport layer, such as the solvents, methylene chloride, tetrahydrofuran, and the like, include a copolymer generated by the free radical polymerization of a fluoroalkyl(methyl)acrylate and an alkyl(methyl)acrylate, and more specifically, fluoropolymers of the following formula

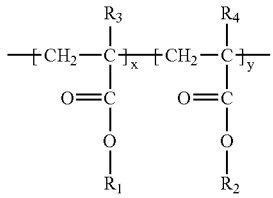

wherein $R_1$ and $R_2$ are as illustrated herein, and more specifically, ethyl, trifluoroethyl, butyl, heptafluorobutyl and the like; and wherein alkyl contains from about 1 to about 18 carbon atoms, and more specifically, from about 2 to about 8 carbon atoms. Thus, $R_1$ and $R_2$ can be alkyl, substituted alkyl, fluorinated alkyl and fluorinated substituted alkyl, subject to the provision that at least one of $R_1$ and $R_2$ is a fluorinated alkyl group or a fluorinated substituted alkyl; $R_3$ and $R_4$ are independently selected from hydrogen and alkyl, such as methyl, ethyl and butyl, with hydrogen and methyl being preferred in embodiments; x and y represent mole fractions of the repeating monomer such that the sum of x+y is equal to about 1, and more specifically, wherein x and y are from about 0.01 to about 0.99, or from about 0.1 to about 0.8, and yet more specifically, wherein $R_1$ is $CH_2CH_2(CF_2)_nF$ and $R_2$ is methyl.

The weight ($M_w$) molecular weight of the disclosed fluoropolymers is, for example, from about 500 to about 50,000, and more specifically, from about 2,000 to about 20,000. The concentration of the fluoropolymer in the charge transport layer is, for example, from about 0.1 weight percent to 50 weight percent by the weight of total solid contents, and more specifically, from about 1 weight percent to about 30 weight percent based on the weight of total solid contents of the charge transport layer.

The fluoropolymers can be economically synthesized by conventional known free radical polymerization. Generally, the fluoroalkyl(meth)acrylates, for example, include trifluoroethyl methacrylate, trifluoroethyl acrylate, 3,3,4,4,5,5,6,6,7,7,8,8,8-tridecafluorooctyl acrylate, 3,3,4,4,5,5,6,6,7,7,8,8,8-tridecafluorooctyl methacrylate, 4,4,5,5,6,6,7,7,8,8,9,9,9-tridecafluoro-2-hydroxynonyl acrylate, 3,3,4,4,5,5,6,6,6-nonafluorohexyl methacrylate, 4,4,5,5,6,6,7,7,7-nonafluoro-2-hydroxyheptyl acrylate, 2,2,3,3,4,4,5,5-octafluoropentyl methacrylate, 2,2,3,3,4,4,4-heptafluorobutyl methacrylate, 2,2,3,3,3-pentafluoropropyl methacrylate, and the like, and wherein the fluoroalkyl(methyl)acrylate is preferably trifluoroethyl methacrylate, trifluoroethyl acrylate, 2,2,3,3,4,4,4-heptafluorobutyl methacrylate, or 2,2,3,3,3-pentafluoropropyl methacrylate, and wherein the amount of the fluoropolymer selected is from about 1 to about 99 percent, and more specifically, from about 10 to about 80 percent.

Illustrative examples of substrate layers selected for the imaging members of the present invention, and which substrates can be opaque, substantially transparent, and the like comprise a layer of insulating material including inorganic or organic polymeric materials, such as MYLAR® a commercially available polymer of a biaxially oriented polyethylene terephthalate available from E.I. DuPont, and containing a conductive metallized titanium surface, alternatively a layer of an organic or inorganic material with a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a rigid cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available from Bayer as MAKROLON® to retain the imaging member in a flat configuration.

The thickness of the substrate layer depends on many factors, including economical considerations, electrical characteristics, and the like, thus this layer may be of substantial thickness, for example over 3,000 microns, such as from about 300 to about 500 microns, or of minimum thickness. In embodiments, the thickness of this layer is from about 75 microns to about 300 microns.

The photogenerating layer, which can, for example, be comprised of hydroxygallium phthalocyanine Type V, is in embodiments comprised of, for example, about 60 weight percent of Type V and about 40 weight percent of a resin binder like polyvinylchloride vinylacetate copolymer such as VMCH (Dow Chemical). The photogenerating layer can contain known photogenerating pigments, such as metal phthalocyanines, metal free phthalocyanines, alkylhydroxyl gallium phthalocyanines, hydroxygallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layer in embodiments of the present invention can be accomplished with spray, dip or wire-bar methods such that the final dry thickness of the photogenerator layer is as illustrated herein and can be, for example, from about 0.01 to about 30 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the amount of polymer binder that is utilized in the photogenerator layer is from about 0 to about 95 percent by weight, and preferably from about 25 to about 60 percent by weight of the photogenerator layer.

As optional adhesive layers usually in contact with the hole blocking layer and photogenerator layer, there can be selected various known substances inclusive of copolyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention further desirable electrical and optical properties.

Aryl amines selected for the charge, especially hole transporting layers, which generally are of a thickness of from about 5 microns to about 75 microns, and more specifically, of a thickness of from about 10 microns to about 40 microns, include molecules of the following formula

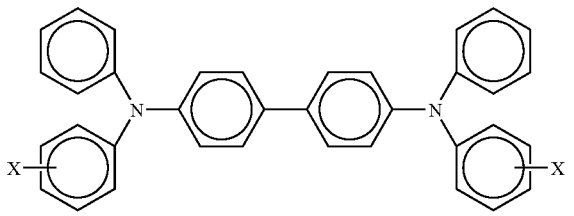

wherein X is alkyl, alkoxy, aryl, a halogen, or mixtures thereof, and especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example, U.S. Pat. Nos. 4,921,773 and 4,464,450, the disclosures of which are totally incorporated herein by reference.

Examples of the binder materials selected for the charge transport layer include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes, poly(cyclo olefins), and epoxies, and random or alternating copolymers thereof. Preferred electrically inactive binders are comprised of polycarbonate resins with a molecular weight of from about 20,000 to about 100,000 with a molecular weight $M_w$ of from about 50,000 to about 100,000 being particularly preferred. Generally, the transport layer contains from about 10 to about 75 percent by weight of the charge transport material, and more specifically, from about 35 percent to about 50 percent of this material.

The optional hole blocking or undercoat layers for the imaging members of the present invention can contain a number of components including known hole blocking components, such as amino silanes, doped metal oxides, TiSi, a metal oxide like titanium, chromium, zinc, tin and the like, a mixture of phenolic compounds and a phenolic resin or a mixture of 2 phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene)diphenol), resorcinol; hydroxyquinone, catechin and the like.

The hole blocking layer can be, for example, comprised of from about 20 weight percent to about 80 weight percent, and more specifically, from about 55 weight percent to about 65 weight percent of a metal oxide, such as $TiO_2$, from about 20 weight percent to about 70 weight percent, and more specifically, from about 25 weight percent to about 50 weight percent of a phenolic resin, from about 2 weight percent to about 20 weight percent and, more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (OxyChem Company) and DURITE™ 97 (Borden Chemical), formaldehyde polymers with ammonia, cresol and phenol, such as VARCUM™ 29112 (OxyChem Company), formaldehyde polymers with 4,4'-(1-methylethylidene)bisphenol, such as VARCUM™ 29108 and 29116 (OxyChem Company), formaldehyde polymers with cresol and phenol, such as VARCUM™ 29457 (OxyChem Company), DURITE™ SD-423A, SD-422A (Borden Chemical), or formaldehyde polymers with phenol and p-tert-butylphenol, such as DURITE™ ESD 556C (Border Chemical).

Also included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additives, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same aforementioned sequence with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

Synthesis of a Fluoropolymer:

Methyl methacrylate (obtained from Aldrich Chemicals Company), 30 grams, and ZONYL™ a (2-(perfluoroalkyl) ethyl methacrylate), $M_n$ about 534, fluoromonomer (obtained from E.I. DuPont Company), 10 grams, and the solvent dioxane, 130 milliliters, containing the free radical initiator 2,2'-azobisisobutyronitrile (AIBN), 0.1 gram, were mixed by magnetic stirring. Under an argon gas flow, the reaction mixture was heated slowly to 100° C. and was stirred at this temperature for 24 hours. After cooling down to room temperature, about 23° C. to about 25° C., the resulting viscous solution was poured into 300 milliliters of methanol with vigorous stirring. The white precipitate, which was collected by filtration, was comprised of a (poly(methyl methacrylate-co-2-(perfluoroalkyl)ethyl methacrylate), $M_w$ about 41,000 and $M_n$ 23,700, as determined by GPC analysis, and which product was purified by an acetone/methanol mixture.

EXAMPLE II

Two multilayered photoreceptors of the rigid drum design were fabricated by conventional coating technology with an aluminum drum of 34 millimeters in diameter as the substrate. These two drum photoreceptors contained the same undercoat layer (UCL) and charge generating layer (CGL). The only difference was that one photoreceptor, Device I, contained a charge transport layer (CTL) control comprising a film forming polymer binder and a charge transport compound whereas the second photoreceptor, Device II, contained a fluoropolymer blend CTL prepared in the same manner and using the same materials as the control CTL.

More specifically, a titanium oxide/phenolic resin dispersion was prepared by ball milling 15 grams of titanium dioxide (STR60N™, Sakai Company), 20 grams of the phenolic resin (VARCUM™ 29159, OxyChem Company, $M_w$ of about 3,600, viscosity of about 200 cps) in 7.5 grams of 1-butanol and 7.5 grams of xylene with 120 grams of 1 millimeter diameter sized $ZrO_2$ beads for 5 days. Separately, a slurry of $SiO_2$ and a phenolic resin were prepared by adding 10 grams of $SiO_2$ (P100, Esprit) and 3 grams of the above phenolic resin into 19.5 grams of 1-butanol and 19.5 grams of xylene. The resulting titanium dioxide dispersion was filtered with a 20 micrometers pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$/VARCUM™ dispersion. Additional solvents of 5 grams of 1-butanol, and 5 grams of xylene; 2.6 grams of bisphenol S (4,4'-sulfonyldiphenol), and 5.4 grams of the above prepared $SiO_2$/VARCUM™ slurry were added to 50 grams of the above resulting titanium dioxide/VARCUM™ dispersion, referred to as the coating dispersion. Then an aluminum drum, cleaned with detergent and rinsed with deionized water, was dip coated with the above generated coating dispersion at a pull rate of 160 millimeters/minute, and subsequently, dried at 160° C. for 15 minutes, which resulted in an undercoat layer (UCL) deposited on the aluminum and comprised of $TiO_2$/$SiO_2$/VARCUM™/bisphenol S with a weight ratio of about 52.7/3.6/34.5/9.2 and a thickness of 3.5 microns.

A 0.5 micron thick photogenerating layer was subsequently coated on top of the above generated undercoat layer from a dispersion of Type V hydroxygallium phthalocyanine (2.4 grams), dihydroxy gallium phthalocyanine (0.6 gram), and a vinyl chloride/vinyl acetate copolymer, VMCH ($M_n$=27,000, about 86 weight percent of vinyl chloride, about 13 weight percent of vinyl acetate and about 1 weight percent of maleic acid) available from Dow Chemical (2 grams), in 95 grams of n-butylacetate. Subsequently, a 24 μm thick charge transport layer (CTL) was coated on top of the photogenerating layer from a solution prepared from N,N'-diphenyl-N,N-bis(3-methylphenyl)-1,1'-biphenyl-4,4'-diamine (5 grams), the above prepared Example I (poly (methyl methacrylate-co-2-(perfluoroalkyl)ethyl methacrylate), $M_w$ of about 41,000 and $M_n$ of about 23,700 (GPC analysis) (0.5 gram), and a film forming polymer binder PCZ-400 [poly(4,4'-dihydroxy-diphenyl-1-1-cyclohexane, $M_w$=40,000)] available from Mitsubishi Gas Chemical Company, Ltd. (4.50 grams) dissolved in a solvent mixture of 20 grams of tetrahydrofuran (THF) and 6.7 grams of toluene. The CTL was dried at 120° C. for 30 minutes to provide the photoreceptor device II.

The photoreceptor drum (device I) with the 24 μm thick CTL control was fabricated by repeating the above process, except that the coating solution of the CTL control was prepared to contain only the N,N'-diphenyl-N,N-bis(3-methylphenyl)-1,1'-biphenyl-4,4'-diamine (5 grams) and the polycarbonate PCZ-400 (5 grams), both dissolved in a solvent mixture of 22.5 grams of tetrahydrofuran (THF) and 7.5 grams of toluene.

The above prepared two photoreceptor devices I and II were electrically tested with an electrical scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 and 700 volts with the exposure light intensity incrementally increased by means of regulating a series of neutral density filters; the exposure light source was a 780 nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.). Two photoinduced discharge characteristic (PIDC) curves were obtained from the two different pre-exposed surface potentials, and the data was interpolated into PIDC curves at an initial surface potential of 600 volts. These two devices possessed similar electrical performance, and Device II possessed an improved residual voltage of 12.2 volts, as compared to that of the Device I control with 15.1 volts.

EXAMPLE III

Surface Test:

The surface properties of the above two photoreceptor devices prepared according to Example II were measured by the water-contact angle test by placing a water droplet over the charge transport layer surface of each device and measuring the angle of the water droplet on the device surface at the point where the two phases met. The advancing contact angles of water on the device surfaces were measured at ambient temperature 23° C., using a Contact Angle System OCA (Dataphysics Instruments GmbH, model OCA15). Deionized water was used to form the water droplet on each photoreceptor device surface. At least ten measurements were performed and the average for each device was noted. The contact angle was 109.6±0.8 degrees for Device II as compared to the contact angle of 90.2±2.2 degrees for Device I. These results indicated that the invention photoreceptor Device H with a CTL containing the fluoropolymer had much lower surface energy thereby enhancing its resistance against molecular species penetration of airborne chemical contaminants into the charge transport layer material matrix and early onset of a charge transport layer cracking problem.

EXAMPLE IV

Cracking Test:

Two photoreceptor devices were prepared by repeating the above processes according to Example II, except that the substrate support was comprised of a flexible 3½ mil thick biaxially polyethylene naphthalate (PEN Kaladex, available from DuPont). The substrate was metallized to provide a 100 angstrom conductive titanium surface. The resulting flexible photoreceptor devices obtained by hand coating process were evaluated for CTL cracking resistance by a solvent vapor exposure induced cracking test.

Each of the photoreceptor devices were cut by using a shear cutting knife to provide a 3"×3" square shape cut piece, and then each was rolled up, with the CTL facing outwardly, into a 19 millimeter tube for a solvent vapor exposure test. The test was conducted for 14 hours in overnight (18 to 20 hours) storage containing each of the rolled up photoreceptor samples in four glass bottles each emitting a sated vapor from each of four different selected solvents at room temperature. Saturated vapor condition for the test was created by placing a vial full of a selected solvent at the bottom of the bottle such that the ambient vapor pressure of the solvent would fill the enclosed glass bottle volume to provide the vapor-liquid equilibrium condition of a saturated vapor state. The confinement of the liquid solvent in the vial was accomplished to prevent direct solvent and photoreceptor sample contact which thereby ensured that testing outcome was due to the effect of the sample exposure to the solvent vapor. The test solvents included isopropyl alcohol, polypropylene glycol, triethanol amine, and cyclic siloxane. Unlike the extensive CTL cracking observed for the photoreceptor Device I, the invention Device II counterpart was totally free of solvent vapor, and the corresponding induced CTL cracking problem examined under 75× magnification using an optical microscope. This result of effectual prevention of solvent vapor exposure CTL layer was a direct indication that the invention photoreceptor Device II with the above prepared fluoropolymer addition in the CTL material provided excellent solvent vapor stability thereby protecting the photoreceptor from airborne volatile chemical attacks under photoreceptor belt machine functioning. Furthermore, the CTL formulation of Device II enabled a surface energy reduction as reflected in its effectiveness of the increasing water contact angle (up to 113 degrees), and thus allowing improved wear resistance in machine subsystems, mechanical interaction subsystems, and other mechanical interactions.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A photoconductive imaging member comprised of a photogenerating layer, and a charge transport layer containing a binder and a fluoropolymer generated by the free radical polymerization of a fluoroalkyl(methyl)acrylate and an alkyl(methyl)acrylate, and wherein said fluoroalkyl(methyl)acrylate is trifluoroethyl methacrylate, trifluoroethyl acrylate, 2,2,3,3,4,4,4-heptafluorobutyl methacrylate, or 2,2,3,3,3-pentafluoropropyl methacrylate, and wherein the amount of said fluoroalkyl(methyl)acrylate present is from about 1 to about 99 weight percent.

2. An imaging member in accordance with claim 1 wherein said fluoropolymer possesses a weight average molecular weight, $M_w$ of from about 500 to about 50,000.

3. An imaging member in accordance with claim 1 wherein said fluoropolymer possesses a weight average molecular weight, $M_w$ of from about 2,000 to about 20,000.

4. An imaging member in accordance with claim 1 wherein said fluoropolymer is present in an amount of from about 1 to about 30 percent by weight.

5. An imaging member in accordance with claim 1 wherein said binder is a polycarbonate, an acrylate polymer, a vinyl polymer, a cellulose polymer, a polyester, a polysiloxane, a polyamide, a polyurethane, a poly(cyclo olefin), or optionally an epoxy polymer.

6. An imaging member in accordance with claim 1 wherein said alkyl(methyl)acrylate is methyl acrylate, methyl methacrylate, ethyl acrylate, propyl methacrylate, butyl methacrylate, or butyl acrylate.

7. An imaging member in accordance with claim 1 wherein said alkyl(methyl)acrylate is methyl methacrylate, ethyl methacrylate, or butyl methacrylate.

8. An imaging member in accordance with claim 1 wherein said binder is a polycarbonate.

9. An imaging member in accordance with claim 1 further including a hole blocking layer, and an adhesive layer.

10. An imaging member in accordance with claim 9 wherein said hole blocking layer is comprised of an amino silane, or wherein said hole blocking layer is comprised of a metal oxide.

11. An imaging member in accordance with claim 1 further containing a substrate and wherein said substrate is a rigid drum.

12. An imaging member in accordance with claim 1 further containing a substrate and wherein said substrate is a flexible belt.

13. An imaging member in accordance with claim 1 wherein said substrate is comprised of a conductive metal of aluminum, aluminized polyethylene terephthalate, or titanized polyethylene terephthalate, or titanized polyethylene naphthalate.

14. An imaging member in accordance with claim 1 wherein said photogenerator layer is of a thickness of from about 0.05 to about 10 microns, and wherein said transport layer is of a thickness of from about 20 to about 70 microns.

15. An imaging member in accordance with claim 1 wherein said photogenerating layer is comprised of a photogenerating pigment or photogenerating pigments dispersed in a resinous binder, and wherein said pigment or pigments are present in an amount of from about 5 percent by weight to about 95 percent by weight, and wherein the resinous binder is optionally selected from the group comprised of vinyl chloride/vinyl acetate copolymers, polyesters, polyvinyl butyrals, polycarbonates, polystyrene-b-polyvinyl pyridine, and polyvinyl formals.

16. An imaging member in accordance with claim 1 wherein the charge transport layer comprises aryl amines, and which aryl amines are of the formula

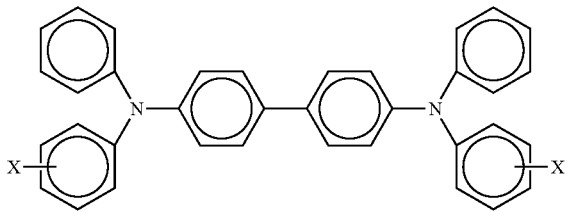

wherein X is selected from the group consisting of alkyl and halogen.

17. An imaging member in accordance with claim 16 wherein said aryl amine is N,N'-diphenyl-N,N-bis(3-methyl phenyl)-1,1'-biphenyl-4,4'-diamine.

18. An imaging member in accordance with claim 1 wherein said photogenerating layer is comprised of metal phthalocyanines, or metal free phthalocyanines.

19. An imaging member in accordance with claim 1 wherein said photogenerating layer is comprised of titanyl phthalocyanines, perylenes, or hydroxygallium phthalocyanines.

20. An imaging member in accordance with claim 1 wherein said photogenerating layer is comprised of Type V hydroxygallium phthalocyanine.

21. A method of imaging which comprises generating an electrostatic latent image on the imaging member of claim 1, developing the latent image, and transferring the developed electrostatic image to a suitable substrate.

22. An imaging member in accordance with claim 1 wherein said photogenerating layer is of a thickness of from about 1 to about 5 microns, and said charge transport layer is of a thickness of from about 20 to about 50 microns.

* * * * *